US008807352B2

(12) United States Patent
Haltmayer et al.

(10) Patent No.: US 8,807,352 B2
(45) Date of Patent: Aug. 19, 2014

(54) CROCKERY BASKET AND DISHWASHER

(75) Inventors: Werner Haltmayer, Dinkelsbühl (DE); Mathias Herrmann, Nattheim (DE); Stefan Kasbauer, Dillingen (DE); Claus Köther, Niederstotzingen (DE); Jens Schlichtmeier, Günzburg (DE); Martin Weissenburger, Bissingen (DE); Mark Woldenberg, Bachhagel (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 540 days.

(21) Appl. No.: 12/933,093

(22) PCT Filed: Mar. 24, 2009

(86) PCT No.: PCT/EP2009/053419

§ 371 (c)(1),
(2), (4) Date: Sep. 17, 2010

(87) PCT Pub. No.: WO2009/118303

PCT Pub. Date: Oct. 1, 2009

(65) Prior Publication Data

US 2011/0011429 A1 Jan. 20, 2011

(30) Foreign Application Priority Data

Mar. 26, 2008 (DE) ..... 10 2008 015 714

(51) Int. Cl.
*A47G 19/08* (2006.01)
*A47L 15/50* (2006.01)

(52) U.S. Cl.
CPC ..... *A47L 15/50* (2013.01)
USPC ..... 211/41.8

(58) Field of Classification Search
CPC ..... A47L 15/50; A47L 15/502; A47L 15/506; A47L 17/00
USPC ..... 211/41.1–41.9, 50, 85.25, 85.31, 133.5, 211/126.9, 132.1, 169, 181.1; 312/311, 312/228, 228.1
See application file for complete search history.

(56) References Cited

U.S. PATENT DOCUMENTS 2,971,668 A * 2/1961 Peglow ..... 220/488
3,625,371 A * 12/1971 Dill ..... 211/153
(Continued)

FOREIGN PATENT DOCUMENTS

DE 7235591 D 6/1973
DE 3130627 C2 7/1988
(Continued)

*Primary Examiner* — Joshua J Michener
*Assistant Examiner* — Devin Barnett
(74) *Attorney, Agent, or Firm* — James E. Howard; Andre Pallapies

(57) ABSTRACT

A crockery basket of a dishwasher for receiving pieces of crockery. The crockery basket includes a bottom; lateral parts framing the bottom; and a row of projecting rods that are arranged on the bottom to hold the pieces of crockery. The row of projection rods has a base wire and individual rod wires that are attached to the base wire. Each end of the base wire is bent and fastened to the bottom and, in an area of the row of projecting rods, the base wire is located at a distance from the bottom.

7 Claims, 3 Drawing Sheets

(56) References Cited

U.S. PATENT DOCUMENTS

| | | | | |
|---|---|---|---|---|
| 3,751,894 | A * | 8/1973 | Ruddell | 57/285 |
| 3,752,322 | A * | 8/1973 | Fiocca et al. | 211/41.8 |
| 4,046,261 | A * | 9/1977 | Yake | 211/41.8 |
| 4,917,248 | A * | 4/1990 | Friskney | 211/41.8 |
| 4,927,033 | A * | 5/1990 | Patera et al. | 211/41.9 |
| 5,351,837 | A * | 10/1994 | Smith | 211/41.8 |
| 5,480,035 | A * | 1/1996 | Smith | 211/41.8 |
| 5,601,195 | A * | 2/1997 | Finola et al. | 211/41.8 |
| 6,546,942 | B2 * | 4/2003 | Smith et al. | 134/201 |
| 6,571,965 | B1 * | 6/2003 | Beck et al. | 211/41.8 |
| 6,848,585 | B2 * | 2/2005 | VanLandingham | 211/41.9 |
| 7,682,465 | B2 * | 3/2010 | Anderson et al. | 134/56 D |
| 7,766,175 | B2 * | 8/2010 | Jadhav et al. | 211/41.9 |
| 7,931,155 | B2 * | 4/2011 | Bastuji | 211/41.9 |
| 2003/0089672 | A1 * | 5/2003 | VanLandingham | 211/41.8 |
| 2005/0109378 | A1 * | 5/2005 | Landsiedel et al. | 134/135 |
| 2006/0289038 | A1 * | 12/2006 | Hedstrom et al. | 134/25.2 |
| 2007/0226928 | A1 * | 10/2007 | Bastuji | 15/104.8 |
| 2008/0083678 | A1 * | 4/2008 | Graute | 211/41.8 |
| 2008/0110481 | A1 * | 5/2008 | Choi et al. | 134/137 |
| 2008/0302740 | A1 * | 12/2008 | Moser et al. | 211/41.8 |
| 2009/0120883 | A1 * | 5/2009 | Jadhav et al. | 211/41.9 |

FOREIGN PATENT DOCUMENTS

| | | | |
|---|---|---|---|
| DE | 29921601 | U1 | 3/2000 |
| DE | 10204692 | A1 | 8/2003 |
| EP | 1665975 | A1 | 6/2006 |
| FR | 2171858 | A1 | 9/1973 |
| FR | 2915364 | A1 | 10/2008 |
| JP | 11206691 | A | 8/1999 |
| JP | 2007130126 | A | 5/2007 |

* cited by examiner

CROCKERY BASKET AND DISHWASHER

BACKGROUND OF THE INVENTION

The present invention relates to a crockery basket of a dishwasher for receiving pieces of crockery, said basket comprising a bottom and lateral parts framing the bottom, with at least one row of projecting rods for holding the pieces of crockery being arranged on the bottom, said row consisting of at least one base wire for the rods and at least one row of projecting rods which is fixed to the base wire and consists of individual rod wires and to a dishwasher with a corresponding crockery basket.

DE 72 35 591 U discloses a crockery basket, which has a bottom framed by lateral parts. The bottom and lateral parts consist of individual wires, which are connected to one another. To receive pieces of crockery, corrugated wires which run in parallel on the bottom of the crockery basket are provided, on which rod wires are arranged with one end in each instance. The other end of the respective rod wire protrudes freely inside the basket. The corrugated wires are used together with the rod wires to receive pieces of crockery. The disadvantage with this embodiment of a crockery basket is the complicated manufacture of the crockery basket as a result of the corrugated wires. The corrugated wires, which are located in the bottom region, are also disadvantageous in that received pieces of crockery, in particular small plates, protrude into a region below the crockery basket between the corrugated wires and the rod wires. In such cases the possibility of the pieces of crockery being damaged by a spray arm which is frequently arranged below the crockery basket cannot be excluded.

DE 299 21 601 U1 discloses a crockery basket for dishwashers, in which a row of projecting rods for holding the pieces of crockery is arranged on the bottom. The row of projecting rods consists of a base wire for the rods and a row of projecting rods fastened thereto and comprising individual rod wires. The base wire for the rods rests here on the bottom of the crockery basket, which is a wire mesh. The pieces of crockery are held by two rows of rods between two rod wires in each instance. If the pieces of crockery are small plates for instance, these protrude through the base mat of the dishwasher and can be damaged by a movement of a spray arm which is arranged below the mesh basket in the dishwasher. The piece of crockery can also come into contact with wires of the base mat of the bottom of the crockery basket, as a result of which the piece of crockery is only held in an unstable fashion and can likewise be damaged.

BRIEF SUMMARY OF THE INVENTION

The object of the present invention is to avoid the aforedescribed disadvantages and to ensure a stable position of a piece of crockery in the crockery basket, thereby preventing damage to the piece of crockery and improving the washing performance and drying process.

The object is achieved by a crockery basket and a dishwasher having the features of the independent claims.

In accordance with the invention, a crockery basket of a dishwasher, for receiving pieces of crockery, comprises a bottom and lateral parts, which frame the bottom. At least one row of projecting rods for holding the pieces of crockery is arranged on the bottom. The row of projecting rods consists of at least one base wire for the rods and at least one row of projecting rods fastened thereto and comprising individual rod wires. The ends of the base wire for the rods are turned, i.e. bent and fastened to the bottom. The fastening creates a fixed and unchangeable fixing of the row of projecting rods in the crockery basket. This reinforces and stabilizes the crockery basket itself. The base wire is distanced from the bottom in the region of the row of projecting rods.

A piece of crockery is held at a distance from the bottom of a crockery basket in a simple and cost-effective fashion with the present invention without additional wires or additional parts. The pieces of crockery are not held in the plane of the bottom but instead in a plane arranged thereabove, as a result of which parts of the pieces of crockery which protrude downwards remain within the crockery basket. A stable storage of the pieces of crockery and thus protection against damage is achieved in this way and the pieces of crockery outside of the crockery basket are also prevented by this from being damaged by moving parts within the dishwasher. This also avoids the pieces of crockery striking housing parts of the dishwasher when the crockery basket is moved into and/or out of the dishwasher and the possibility of said pieces of crockery being damaged during this process.

With the inventively designed crockery basket, the holding of the pieces of crockery in the rows of projecting rods is achieved without any significant additional outlay involved when manufacturing the crockery basket. By bending the ends of the base wire for the rods and by fastening these bent ends of the base wire for the rods to the bottom, the central region of the base wire for the rods, to which the individual rod wires are fastened, is raised relative to the bottom. A distance of the base wire for the rods from the bottom is thus produced in particular between the central region of the base wire for the rods and the bottom. If the pieces of crockery are at least partially placed and held on the base wire for the rods, these pieces of crockery, in particular small plates, protrude into the region between the base wire for the rods and the bottom, but however not below the bottom. They are therefore protected from damage from below. The pieces of crockery are usually expediently held by two identically embodied rows of projecting rods, with each individual piece of crockery being arranged on two parallel base wires for the rods and between a total of four rod wires. The piece of crockery is thus held above the bottom.

The bottom advantageously consists of a base mat made of wire. This base mat, which essentially corresponds to a wire mesh, can be manufactured cost-effectively and ensures good accessibility to the piece of crockery for the cleaning fluid as well as good drying of the piece of crockery. The base mat made of wire allows for a good stability of the crockery basket with the piece of crockery being covered as little as possible relative to the cleaning liquid and the best possible drip-drying of the drying piece of crockery.

If the base wire is fastened to the base mat with its ends, a particularly simple connection is achieved between the base mat of the bottom and the base wire for the rods of the row of projecting rods. The base wire is advantageously fastened to the base mat by means of welding. The row of projecting rods is thus firmly arranged in the crockery basket and thus enables very stable holding of the pieces of crockery.

If the base wire is fastened, in particular welded, especially to wires of the base mat which run at a right angle to the base wire, a very simply embodied connection is created, which can be effectively welded. The connection can be maintained over a long period of time and without the need for additional fastening elements.

It is advantageous if at least one end of the base wire comprises a double bend, in which both bends preferably are essentially made at right angles to one another and after the second bend the wire piece again runs essentially in parallel to the wire piece before of the first bend. The bend is preferably essentially made here in the plane of the row of projecting rods. As a result, the wire piece of the base wire for the rods which runs between the first and second bend essentially determines the amount of the distance of the row of projecting rods and/or the base wire for the rods from the bottom. The wire end after the second bend enables a very simple connection to the bottom, in particular a base mat of the bottom, by this wire end being placed on the wire of the bottom and being connected, in particular welded hereto.

If at least one end of the base wire preferably comprises a single bend, a connection with the bottom, in particular a base mat made of wire, is expediently very simple by crossing the two wires. This singly bent end of the base wire is crossed with the wire of the base mat, as a result of which a connection between two crossed wires, for instance by means of a welding, is possible. The distancing of the row of projecting rods is achieved by the free end of the base wire for the rods being connected to the bottom and as a result the region of the base wire for the rod, to which the row of projecting rods comprising individual rows of projecting rods is fastened, runs at a distance from the bottom of the crockery basket.

It is particularly advantageous for one end of the base wire to comprise a single bend and the other end to comprise a double bend. While the end with the single bend is fastened to a wire of the base mat of the bottom, the end of the base wire with the double bend rests on or below another wire of the base mat and is likewise connected herewith. The advantageous double bend produces a contact area of the base wire for the rods on the wire of the base mat, which allows the base wire for the rods to be fastened to the wire of the base mat over a wider area, namely over the entire length of the free end of the base wire for the rods. This enables allowances to be made for the manufacturing tolerances of the base mat of the crockery basket and the row of projecting rods with the base wire for the rods. Increasing the permissible manufacturing tolerances in its turn provides a measure to enable cost-effective manufacturing of the inventive crockery basket.

The distance of the base wire from the bottom of the crockery basket is determined in particular by the length of the bent ends of the base wire. By being fastened to the bottom of the crockery basket these lead to a space between it and the holding points for the piece of crockery. In this arrangement the piece of crockery is received between two rows of projecting rods and is located between a total of four rod wires and rests on the two base wires of the rows of projecting rods. The distance between the base wire for the rods and the bottom of the crockery basket advantageously results in a piece of crockery which is received therein, in particular a plate, not touching the bottom of the crockery basket and/or the base mat or even protruding therethrough. The piece of crockery is herewith received in a stable fashion and is also protected against damage.

The rod wires are preferably aligned at an angle in respect of the base wire. The reception of large pieces of crockery is herewith facilitated and both the cleaning and also the drying of the pieces of crockery is improved by the angled position of the pieces of crockery. The angled position of the pieces of crockery means that no or only a few points on the piece of crockery run horizontally, so that the water can drain away rapidly and without leaving behind any traces of drying.

A dishwasher with an afore-described crockery basket can be manufactured cost-effectively and results in very good cleaning and drying of the pieces of crockery located therein.

The inventively designed crockery basket, by establishing a distance between a piece of crockery and the base mat of a crockery basket, avoids undefined contact points arising on the piece of crockery, as a result of which the washing performance and the drying process is improved. While in the case of a comparable dishwashers, a distance is established by means of additional wires and/or additional parts, which increase the costs as a result of their introduction into the cutlery basket, a more cost-effective and reliable crockery basket is created with the present invention. The inventive crockery basket construction describes a fixed row of projecting rods of a crockery basket, with which it is possible, without using additional wires, to raise the pieces of crockery from the base mat and to prevent contact points. The distance is preferably realized by a targeted bending of the base wire for the rods at the start and end. The row of projecting rods has two different bends in a preferred embodiment at the ends. In particular, a single bend is used as a direct welding point, preferably a double bend is used to allow for tolerances of the second weld in order to compensate for manufacturing tolerances. Advantages of the inventively designed crockery basket are the simplified manufacture, which is integrated into the rod manufacture and only requires a minimal additional outlay in order to bend the wire ends. No additional bent wire is needed, as a result of which a time and cost saving is achieved in comparison with known solutions.

BRIEF DESCRIPTION OF THE DRAWINGS

Other developments of the invention are reproduced in the subclaims. The invention and its development as well as its further advantages are described in the subsequent exemplary embodiment, in which;

DETAILED DESCRIPTION OF EXEMPLARY EMBODIMENTS OF THE PRESENT INVENTION

Figure 1:
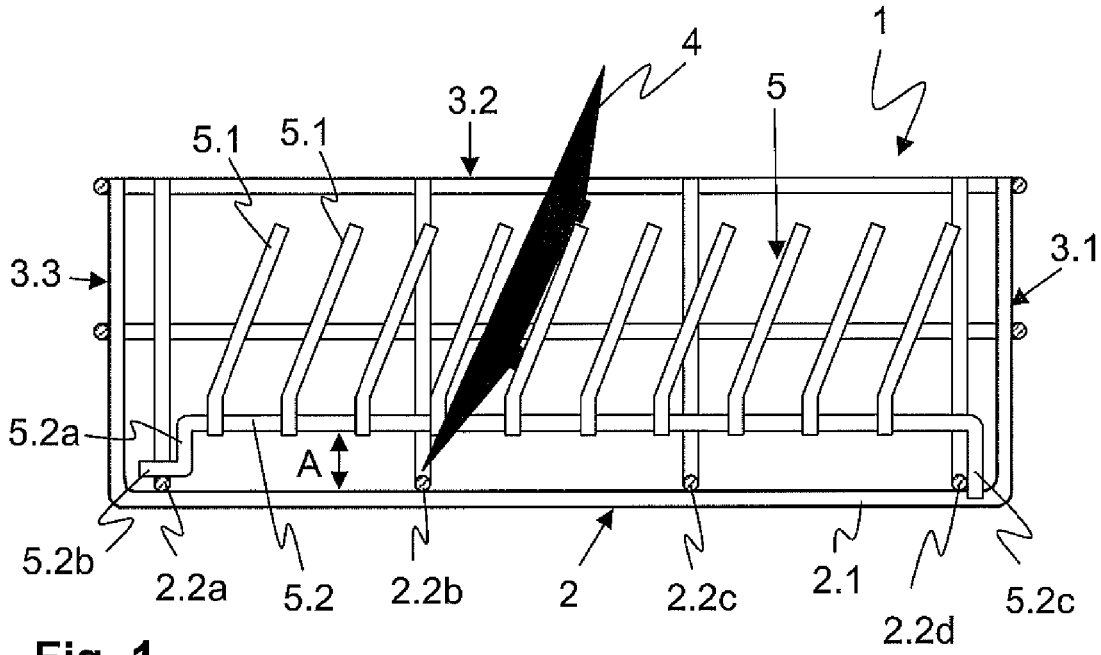
FIG. 1 shows a schematic representation of a cross section through a crockery basket.

FIG. 1 shows a schematic representation of a section through an inventively designed crockery basket 1. The crockery basket 1 consists of a base mat 2, which forms the bottom of the mesh basket 1. The bottom is framed by lateral parts 3.1, 3.2 and 3.3. A fourth lateral part is not shown. The lateral parts 3.1, 3.2 and 3.3 likewise consist, like the base mat 2 of the bottom, of crossing wires connected to one another. These wires effect a minimal shielding of the pieces of crockery to be cleaned and as a result also form a very good drying process of the pieces of crockery, since no backwater forms. A piece of crockery 4 is shown schematically in the crockery basket 1.

The base mat 2 consists of longitudinal wires 2.1 and transverse wires 2.2*a* to 2.2*d*. A row of projecting rods 5 is provided to receive the pieces of crockery 4. The row of projecting wires 5 consists of a plurality of rod wires 5.1 which are fastened to a base wire for the rods 5.2. In the present exemplary embodiment, the rod wire 5.1 is fastened, in particular welded, to the base wire for the rods 5.2 at a right angle, and is consequently bent thereto. The bending causes the piece of crockery 4 to be held at an angle, so that no backwater forms on the piece of crockery 4 and thus no drying spots appear. All essential surfaces of the held pieces of crockery 4 are preferably inclined by an angle of approx. 30° relative to the horizontal so that the water can flow effectively away from the piece of crockery 4. The piece of crockery 4 is held between two rod wires 5.1 of a row of projecting rods 5. It also rests here against the base wire for the rods 5.2.

In particular, the base wire for the rods 5.2 is bent at its ends. The bent ends in their turn are fixed to the bottom. In the present exemplary embodiment, the base wire for the rods 5.2 comprises a double bend at its left end. The center piece 5.2*a* produced as a result is essentially bent at a right angle to the base wire for the rods 5.2. The end piece 5.2*b* protruding outwards in accordance with the second bend essentially runs again in parallel to the base wire for the rods 5.2. The end piece 5.2*b* is fixed, in particular welded, to the transverse wire 2.2*a* of the base mat 2 of the bottom. In the present exemplary embodiment, a further end piece 5.2*c* is located at the other end of the base wire for the rods 5.2, said further end piece 5.2*c* only being bent easily and essentially at right angles thereto relative to the base wire for the rods. This end piece 5.2*c* is also connected, in particular welded, to the bottom, here with the transverse wire 2.2*d* of the base mat 2.

The different bending of the end pieces 5.2*b* and 5.2*c* cause the base wire for the rods 5.2 to strike the transverse wire 2.2*d* acting as a stop and fixed be thereto. The position of the base wire for the rods 5.2 is herewith defined very accurately. A fastening point is created at the other end of the base wire for the rods 5.2 by means of the double bend and the end piece 5.2*b* running as a result in parallel to the base wire for the rods 5.2, said fastening point resting on the transverse wire 2.2*a* of the base mat 2 of the bottom and being fastened thereto, in particular welded. A tolerance compensation is herewith possible, which results from manufacturing tolerances of the bottom and/or the base mat 2 and the row of projecting rods 5. This design enables allowance to be made for several millimeters, which are not essential to the function of the row of projecting rods 5 but significantly simplifies the manufacture of the dishwasher 1 and the row of projecting rods 5 and allows the process to be implemented in a more cost-effective fashion.

The lengths of the center piece 5.2*a* and the end piece 5.2*c* are attuned to one another such that the end piece 5.2*c* rests laterally against the transverse wire 2.2*d* and can be fastened thereto, while the end piece 5.2*b* rests against the other end of the base wire for the rods 5.2 on the transverse wire 2.2*a* running at approximately the same height. A parallel alignment of the base wire for the rods 5.2 is herewith effected relative to the bottom and/or base mat 2. In particular, a predetermined length of the center piece 5.2*a* and the end piece 5.2*c* also produces a distance A between the wire base for the rods 5.2 and the base mat 2. This distance A is selected in particular such that pieces of crockery 4, which are intended to be accommodated in the row of projecting rods 5, have no contact with the base mat 2 and/or the bottom and also do not protrude through the base mat 2 and/or the bottom. This ensures that spray arms, which move below the base mat 2, do not come into contact with the piece of crockery 4 and could thus result in damage to the piece of crockery 4. Furthermore the pieces of crockery 4 are held stably by using two rows of projecting rods 5 arranged in parallel, as is explained again in more detail in the following figures.

Figure 2:
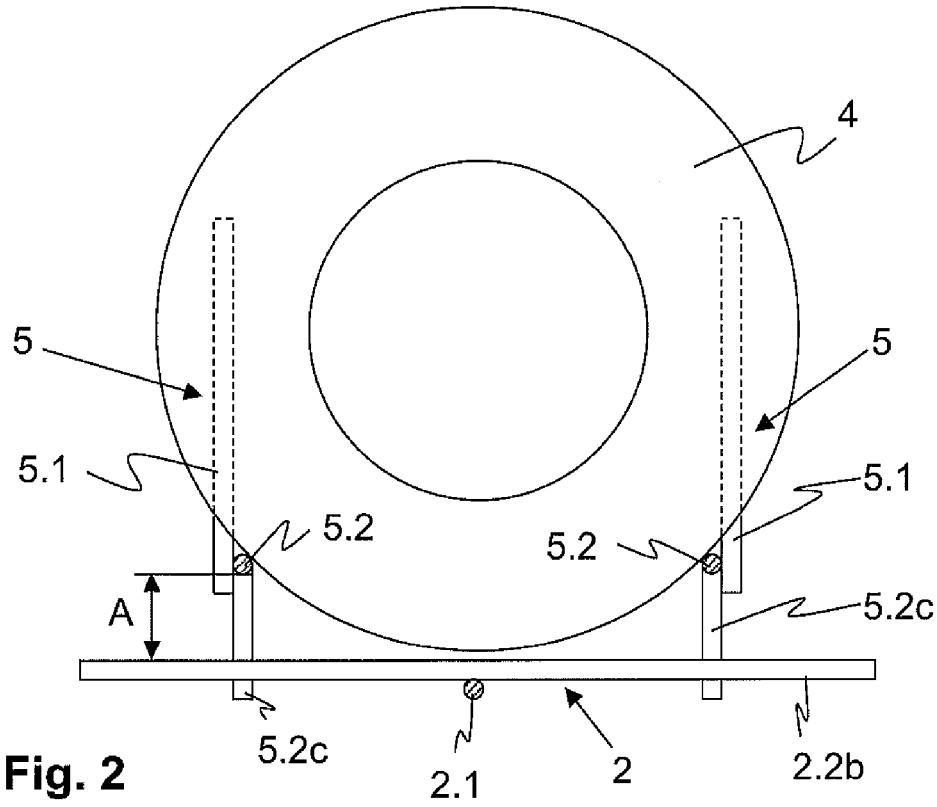
FIG. 2 shows a schematic representation of a cross section through two rows of projecting rods which run in parallel.

Accordingly FIG. 2 shows a sectional view transverse to the representation in FIG. 1. This second figure shows the piece of crockery 4, here a plate, which is mounted on two base wires for the rods 5.2 which run in parallel. The piece of crockery 4 also rests against the rod wires 5.1 of the two rows of projecting rods 5. The base wires for the rods 5.2 are disposed at a distance A from the transverse wire 2.2*b* in order to prevent the piece of crockery 4 from coming into contact with the transverse wire 2.2*b*. The distance A can be determined, depending on the embodiment and arrangement of the rows of rods 5, in respect of the transverse wires 2.2*a* to 2.2*d* and/or the longitudinal wires 2.1 as a distance between the base wire for the rods 5.2 and the longitudinal wire 2.1 or as a distance between the base wire for the rods 5.2 and the transverse wire 2.2*a* to 2.2*d*. It is in any case essential for there to be no contact between the piece of crockery 4 provided and one of the longitudinal wires and transverse wires 2.1, 2.2.

Figure 3:
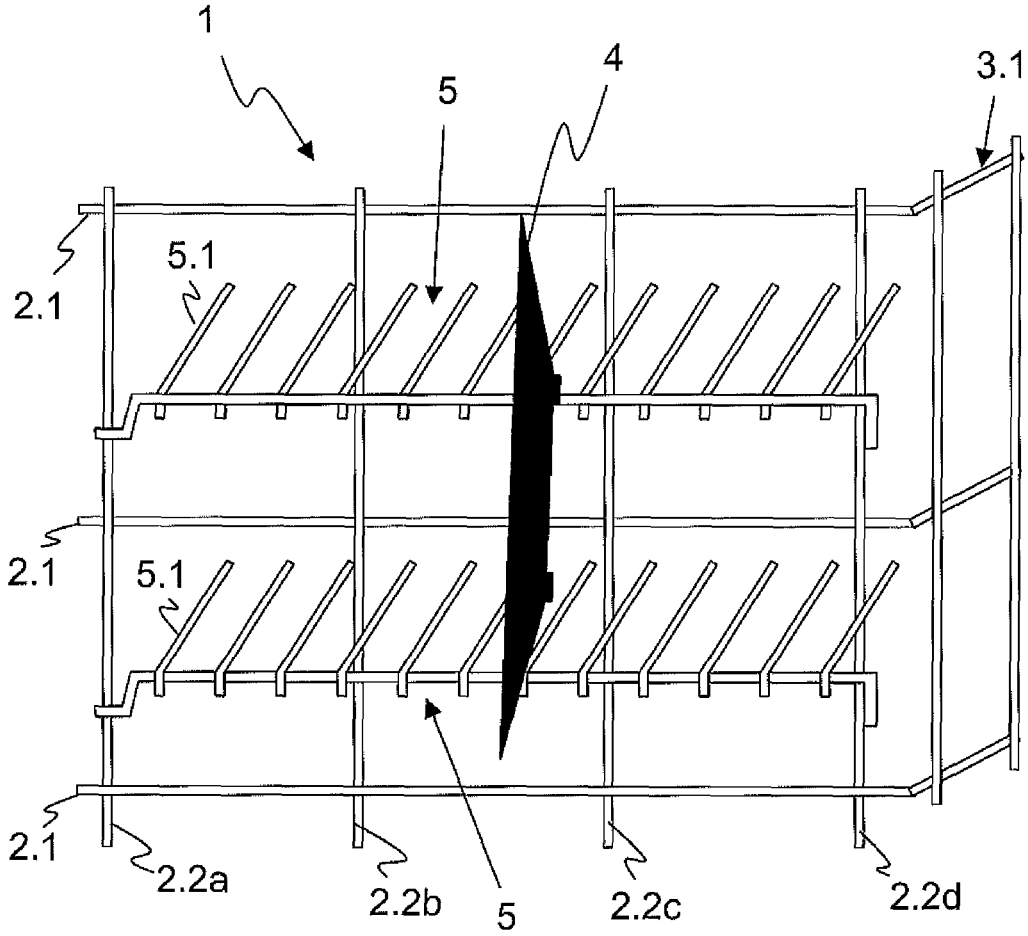
FIG. 3 shows a perspective view of a section of a crockery basket.
Figure 4:
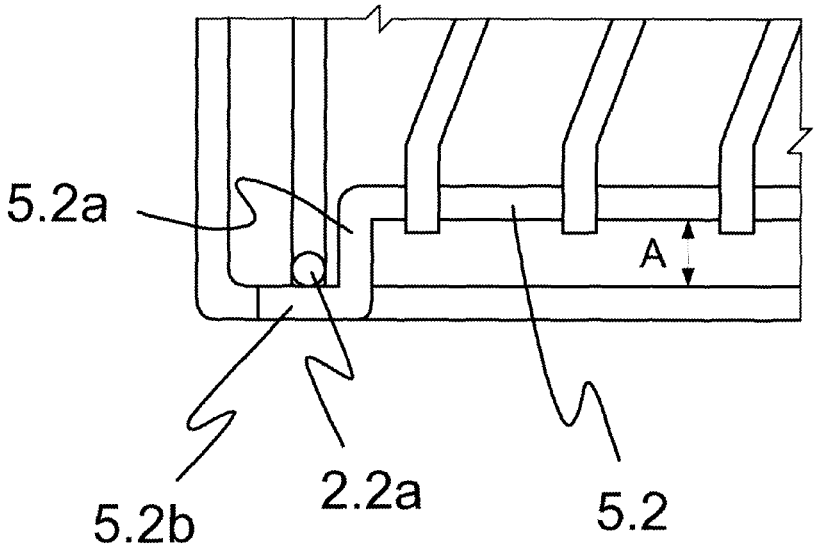
FIG. 4 shows a schematic representation of a partial cross section through a crockery basket according to another exemplary embodiment.

FIG. 3 shows a schematic perspective representation of a section from an advantageous crockery basket 1, which is designed according to the inventive principle. The two essentially parallel rows of projecting rods 5 are shown again. Each row of projecting rods 5 comprises a base wire for the rods 5.2, to which a plurality of rod wires 5.1 are fastened. The ends of the base wire for the rods 5.2 are provided on one side with a single bend and on the other side with a double bend. On the single bend side this creates, a stop in the horizontal direction and on the other side the double bend creates a vertical stop of the row of projecting rods 5. Manufacturing tolerances are compensated for by these two different stops. The row of projecting rods 5 can be rigidly arranged on the bottom, here on the base mat 2. The piece of crockery 4 is held between two rows of rods 5 by the rod wires 5.1 and the base wire for the rods 5.2. Contact with the bottom of the crockery basket 1 is prevented by the distance between the base wires for the rods 5.2 and the bottom of the crockery basket 1 when using the pieces of crockery 4 provided.

The present invention is not restricted to the exemplary embodiments shown. In particular, similar bends are possible at the ends of the base wire for the rods. The base wires for the rods 5.2 can also be fastened to the longitudinal wires 2.1 of the base mat 2, if this is advantageous in the case of the crockery basket 1 and the division thereof. It is particularly advantageous if no additional bent wire is necessary, but that the distance of the base wire for the rod 5.5 is achieved solely by means of its shape. Simple manufacturing, which is integrated into the production of the rods, is herewith achieved with only minimal time outlay for bending the wire ends and thus a considerable cost-saving in comparison with the known rows of rods. The pieces of crockery are held in accordance with the invention at a distance from the base crockery basket, as a result of which a good cleaning and drying effect are achieved with simultaneously stable holding of the pieces of crockery.

| List of reference characters | |
|---|---|
| 1 | Crockery basket |
| 2 | Base mat |
| 2.1 | Longitudinal wire |
| 2.2a-d | Transverse wire |
| 3.1-3.3 | Lateral parts |
| 4 | Piece of crockery |
| 5 | Row of projecting rods |
| 5.1 | Rod wire |
| 5.2 | Base wire for the rods |
| 5.2a | Center piece |
| 5.2b | End piece |
| 5.2c | End piece |
| A | Distance |

The invention claimed is:

1. A crockery basket of a dishwasher for receiving pieces of crockery, the crockery basket comprising:

a bottom;

a plurality of lateral parts framing the bottom; and at least one row of projecting rods arranged within the crockery basket to hold the pieces of crockery, the at least one row of projection rods having a base wire and a plurality of individual rod wires attached to the base wire;

wherein the base wire has a horizontal central wire region and a bent wire portion at each end of the base wire, each bent wire portion extending from the horizontal central wire region and extending downward toward the bottom and each bent wire portion being fastened to the bottom such that the horizontal central wire region is arranged at a predetermined distance from the bottom in a predetermined area of the at least one row of projecting rods, and wherein each of the plurality of individual rod wires includes a fixed end attached to the horizontal central wire region and a free end extending upward from the horizontal central wire region in a direction opposite to the bottom, the plurality of individual rod wires each cooperates with the horizontal central wire region to hold the pieces of crockery in the basket, wherein the horizontal central wire region and the bent wire portion are arranged in a same vertical plane, and wherein the individual rod wires extend upward from the horizontal central wire region in a vertical plane that is parallel to the vertical plane of the horizontal central wire region and the bent wire portions;

wherein the bottom is a base mat including at least a first horizontal wire and second horizontal wire arranged perpendicular to the same vertical plane, wherein one of the bent portions is a first free end of the base wire that has a single bend and one of the bent portions is a second free end of the base wire that has a double bend, wherein the single bend and the double bend are arranged in the same vertical plane as the horizontal central wire region, wherein the single bend forms a vertical free end that crosses the first horizontal wire of the base mat in a vertical direction to fix a position of the base wire with respect to the base mat in a direction extending along the same vertical plane, and wherein the double bend forms a horizontal free end that crosses the second horizontal wire of the base mat in a transverse direction to increase a contact area of the second free end of the base wire with the base mat in the direction extending along the same vertical plane, thereby compensating for manufacturing tolerances of the base wire and facilitating the leveling of the horizontal central wire region with respect to the base mat; wherein the end having the single bend is welded as a direct weld laterally to a side surface of the first horizontal wire of the base mat, and wherein the other end having the double bend is welded to one of an upper or lower surface of the wire of the base mat.

2. The crockery basket of claim 1, wherein the first and second horizontal wires of the base mat are aligned at respective right angles to the base wire.

3. The crockery basket of claim 1, wherein respective lengths of the bent ends of the base wire are structured such that a distance of the base wire from the bottom of the crockery basket is predetermined.

4. The crockery basket of claim 1, wherein plurality of individual rod wires are aligned at a respective angle to the base wire.

5. A dishwasher having at least one crockery basket, the at least one crockery basket comprising:

a bottom;

a plurality of lateral parts framing the bottom; and at least one row of projecting rods arranged within the crockery basket to hold the pieces of crockery, the at least one row of projection rods having a base wire and a plurality of individual rod wires attached to the base wire;

wherein the base wire has a horizontal central wire region and a bent wire portion at each end of the base wire, each bent wire portion extending from the horizontal central wire region and extending downward toward the bottom and each bent wire portion being fastened to the bottom such that the horizontal central wire region is arranged at a predetermined distance from the bottom in a predetermined area of the at least one row of projecting rods, wherein each of the plurality of individual rod wires includes a fixed end attached to the horizontal central wire region and a free end extending upward from the horizontal central wire region in a direction opposite to the bottom, the plurality of individual rod wires each cooperates with the horizontal central wire region to hold the pieces of crockery in the basket, wherein the horizontal central wire region and the bent wire portion are arranged in a same vertical plane, and wherein the individual rod wires extend upward from the horizontal central wire region in a vertical plane that is parallel to the vertical plane of the horizontal central wire region and the bent wire portions;

wherein the bottom is a base mat including at least a first horizontal wire and second horizontal wire arranged perpendicular to the same vertical plane, wherein one of the bent portions is a first free end of the base wire that has a single bend and one of the bent portions is a second free end of the base wire that has a double bend, wherein the single bend and the double bend are arranged in the same vertical plane as the horizontal central wire region, wherein the single bend forms a vertical free end that crosses the first horizontal wire of the base mat in a vertical direction to fix a position of the base wire with respect to the base mat in a direction extending along the same vertical plane, and wherein the double bend forms a horizontal free end that crosses the second horizontal wire of the base mat in a transverse direction to increase a contact area of the second free end of the base wire with the base mat in the direction extending along the same vertical plane, thereby compensating for manufacturing tolerances of the base wire and facilitating the leveling of the horizontal central wire region with respect to the base mat; wherein the end having the single bend is welded as a direct weld laterally to a side surface of the first horizontal wire of the base mat, and wherein the other end having the double bend is welded to one of an upper or lower surface of the wire of the base mat.

6. The dishwasher of claim 5, wherein the first and second horizontal wires of the base mat are aligned at respective right angles to the base wire.

7. The dishwasher of claim 5, wherein the plurality of individual rod wires are aligned at a respective angle to the base wire.

* * * * *